US006360532B2

(12) United States Patent
Strähle et al.

(10) Patent No.: US 6,360,532 B2
(45) Date of Patent: Mar. 26, 2002

(54) EXHAUST GAS HEAT EXCHANGE SYSTEM FOR AN INTERNAL COMBUSTION ENGINE

(75) Inventors: Roland Strähle, Unterensingen; Wolfgang Knecht, Stuttgart; Thomas Eckert, Waldenbuch; Thomas Jantschek, Neuweiler, all of (DE)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 09/777,326

(22) Filed: Feb. 6, 2001

(30) Foreign Application Priority Data

Mar. 11, 2000 (DE) ..... 100 11 954

(51) Int. Cl.[7] ..... F01N 3/02

(52) U.S. Cl. ..... 60/321; 60/320; 60/278; 60/280; 60/324; 60/605.2; 123/568.12

(58) Field of Search ..... 60/321, 320, 278, 60/280, 292, 324, 605.2, 605.1; 123/568.12

(56) References Cited

U.S. PATENT DOCUMENTS

| | | | | |
|---|---|---|---|---|
| 5,785,030 A | * | 7/1998 | Paas | 60/278 |
| 5,794,445 A | * | 8/1998 | Dungner | 60/605.2 |
| 5,806,308 A | * | 9/1998 | Khair et al. | 60/278 |
| 6,116,026 A | * | 9/2000 | Freese, V | 60/605.2 |
| 6,176,082 B1 | * | 1/2001 | Shaffer | 60/321 |
| 6,213,105 B1 | * | 4/2001 | Banzhaf et al. | 123/568.12 |

FOREIGN PATENT DOCUMENTS

| | | |
|---|---|---|
| DE | 29722813 | 4/1999 |
| EP | 0913562 | 5/1999 |

OTHER PUBLICATIONS

DieselNet Technology Guide www.DieselNet.com.Copyright © Ecopoint Inc. (Nov. 29, 2000).

* cited by examiner

*Primary Examiner*—Thomas Denion
*Assistant Examiner*—Binh Tran
(74) *Attorney, Agent, or Firm*—Wood, Phillips, VanSanten, Clark & Mortimer

(57) ABSTRACT

An exhaust gas heat exchange system for an internal combustion engine (10) includes an intake manifold (12) including an inlet (16) for recirculating exhaust gases and an exhaust manifold (28) having at least one inlet (30) for receiving exhaust gas from the engine (10) and an outlet (36), (60), for discharging exhaust gas and spaced from the inlets (30). An exhaust gas heat exchanger (32) includes a first flow path having an inlet (50) connected to the exhaust manifold (32) to receive exhaust gas therefrom, an outlet (52) for discharging cooled exhaust therefrom and a second flow path in heat exchange relation with the first flow path for receipt of a coolant whereby exhaust gas flowing in the first flow path may be cooled. An exhaust valve (32) has a first inlet (44) connected to the first flow path of the heat exchanger (32), a second inlet (47) connected to the exhaust manifold (28) and an outlet (48) connected to the intake manifold (12) together with a valve mechanism having at least one movable component (56) movable between positions connecting the first inlet (44) and the outlet (48) and connecting the second inlet (47) and the outlet (48). An actuator (76) is connected to the exhaust valve (32) for operating the same.

12 Claims, 4 Drawing Sheets

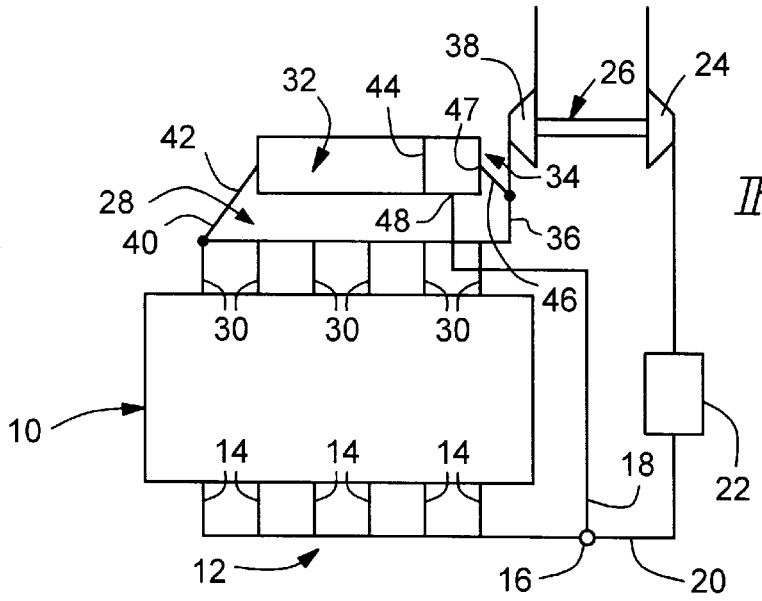
FIG. 1
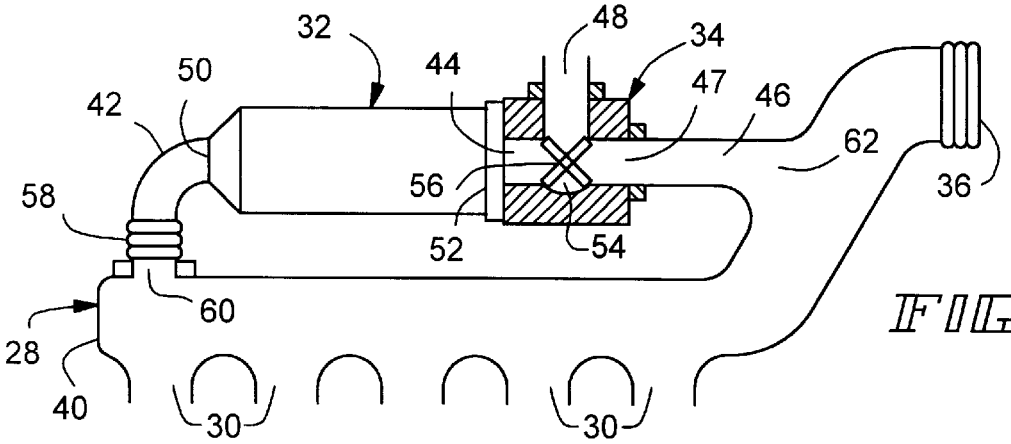
FIG. 2
FIG. 3
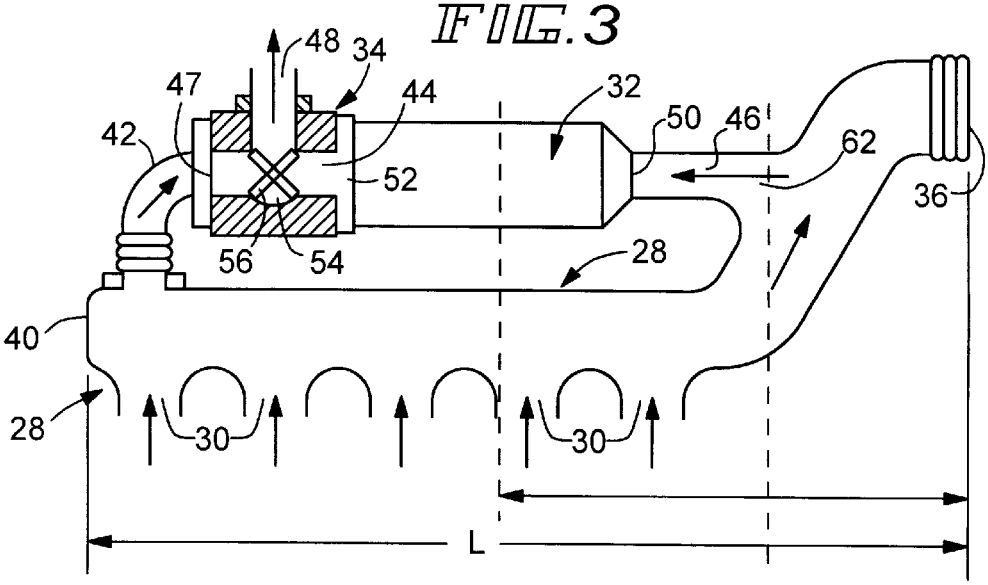

EXHAUST GAS HEAT EXCHANGE SYSTEM FOR AN INTERNAL COMBUSTION ENGINE

FIELD OF THE INVENTION

This invention relates to an exhaust gas heat exchanger system, and more specifically, to such a system intended for use with an internal combustion engine.

BACKGROUND OF THE INVENTION

Emission concerns associated with the operation of internal combustion engines, generally, but not always, diesel engines, have resulted in an increased emphasis on the use of exhaust gas heat exchange systems with such engines, particularly, but not always, in vehicular applications. These systems are employed as part of an exhaust gas recirculation (EGR) system by which a portion of an engine's exhaust is returned to its combustion chambers via its intake system. The result is that some of the oxygen that would ordinarily be inducted into the engine as part of its fresh combustion air charge is displaced with inert gases thus reducing the rate of $NO_x$ formation. EGR is also frequently designed to absorb heat from the combustion process, thus lowering its temperature and providing a further reduction in $NO_x$. It has been shown that EGR is a very effective method in achieving $NO_x$ reduction.

As generally alluded to previously, dilution of the combustion air with inert gases decreases the oxygen concentration of the mixture being combusted with the engine, thereby reducing the availability of oxygen for combination with nitrogen that would result in $NO_x$. Temperature reduction in the combustion process, also leading to a reduction in $NO_x$, is believed to be primarily due to the heat absorbing capacity of $CO_2$ and $H_2O$ in the exhaust gas and the disassociation of $CO_2$ which reduces combustion pressures and temperatures.

In many applications employing EGR, exhaust gas heat exchangers are employed. In the usual case, engine coolant is brought into heat exchange relation with the exhaust gas prior to its recirculation so as to lower its temperature. Not only does this provide a beneficial effect in terms of a reduced temperature of the gases entering the combustion chamber, leading to reduced combustion temperatures and the associated reduction of $NO_x$, it causes the exhaust gases to become more dense due to their reduction in temperature so that for a given volumetric recirculation flow rate, a greater quantity of the exhaust gas is recirculated to the intake side of the engine, thereby promoting greater dilution of the intake air and promoting the associated reduction in $NO_x$.

However, there are instances during the cycle of operation of an internal combustion engine wherein reduction of the temperature of the exhaust gas by an exhaust gas heat exchanger is undesirable. For example, where the exhaust system for the internal combustion engine is equipped with a catalytic converter to treat exhaust gases to reduce emissions, it is generally necessary that the catalytic converter operate at a high temperature to be effective. Of course, at start up, the catalytic converter will be at ambient temperature and ineffective. Thus, at start up, it is desired that uncooled exhaust gas be discharged into the catalytic converter to quickly bring it up to a temperature whereat it may be effective. Moreover, some sources have indicated a preference for bypassing the exhaust gas heat exchanger in conditions such as idle or no load conditions which often improves idle, no load and part load fuel economy while reducing hydrocarbon and carbon monoxide emissions.

In some situations, it is difficult to achieve effective EGR because of the absence of a sufficient pressure differential between the exhaust gas recirculation line and the intake manifold. Thus, it is desirable that the exhaust gas heat exchange system minimize pressure drop so as to allow sufficient introduction of exhaust gases into the intake side of the engine to achieve the benefits of EGR.

The present invention is directed to overcoming one or more of the above problems.

SUMMARY OF THE INVENTION

It is the principal object of the invention to provide a new and improved exhaust gas heat exchanger for use with an internal combustion engine. Even more particularly, it is an object of the invention to provide such a system that is ideally suited for use with an internal combustion engine employed to propel a vehicle.

An exemplary embodiment of the invention achieves the foregoing objects in an exhaust gas heat exchange system for internal combustion engines which includes an intake manifold having an inlet for recirculating exhaust gas. Also included is an exhaust manifold having at least one inlet receiving exhaust gas from an engine as well as an outlet for discharging exhaust gas and spaced from the inlet(s). An exhaust gas heat exchanger includes a first flow path having an inlet connected to the exhaust manifold to receive exhaust gas therefrom, an outlet for discharging cooled exhaust gas and a second flow path in heat exchange relation with the first flow pass for receipt of a coolant whereby exhaust gas flowing in the first flow path may be cooled. An exhaust valve having a first inlet is connected to the first flow path outlet. It also includes a second inlet connected to the exhaust manifold and an outlet connected to the intake manifold inlet. A valve mechanism is included and has at least one movable component which is movable between positions (a) connecting the exhaust valve first inlet to the exhaust valve outlet and (b) connecting the exhaust valve second inlet to the exhaust valve outlet. Finally, an actuator is connected to the valve mechanism for moving the valve mechanism component(s) between the two aforementioned positions.

In one embodiment, the exhaust valve second inlet is connected to the exhaust manifold at a location downstream of the exhaust manifold inlet(s) and upstream of the exhaust manifold outlet.

A preferred embodiment contemplates that the exhaust valve second inlet be connected to the exhaust manifold closely adjacent to the exhaust manifold outlet.

In one embodiment, the first flow path inlet and the exhaust valve first and second inlets are approximately aligned with one another.

Preferably, the exhaust gas heat exchanger and the exhaust valve are mounted on the exhaust manifold.

In a highly preferred embodiment, the exhaust manifold is elongated and the second inlet is connected to the exhaust manifold at a location that is spaced from the exhaust manifold outlet a distance equal to one-half or less of the length of the exhaust manifold. Even more preferably, the distance is one-third or less of the length of the exhaust manifold.

A preferred embodiment of the invention contemplates that the exhaust manifold be elongated and the exhaust manifold outlet be adjacent to one end thereof. The exhaust gas heat exchanger first flow path inlet has a connection to the exhaust manifold at a location intermediate the ends thereof.

Preferably, the connection is closely adjacent and end of the exhaust manifold opposite the one end.

A preferred embodiment of the invention also contemplates that the exhaust gas heat exchanger and the exhaust manifold both be elongated and that the exhaust valve is mounted on one end of the exhaust gas heat exchanger to form an elongated assembly. The assembly is disposed generally parallel to the exhaust manifold.

In a highly preferred embodiment, the exhaust valve first inlet, second inlet and outlet intersect at a common location and the valve component(s) includes a valve member located at the common location.

Even more preferably, the exhaust gas heat exchanger is elongated and has an axis of elongation, and the exhaust valve first and second inlets are approximately aligned on the axis of elongation. The exhaust valve outlet is disposed approximately transverse to the axis of elongation.

Other objects and advantages will become apparent from the following specification taken in connection with the accompanying drawings.

DESCRIPTION OF THE DRAWINGS

FIG. 1 is a schematic of a turbocharged internal combustion engine employing exhaust gas recirculation and including an exhaust gas heat exchange system made according to the invention;

FIG. 2 is a partial schematic, partial mechanical depiction of part of one embodiment of the exhaust gas heat exchange system of the invention;

FIG. 3 is a view similar to FIG. 2 but showing an alternative embodiment;

DESCRIPTION OF THE PREFERRED EMBODIMENTS

Figure 4:
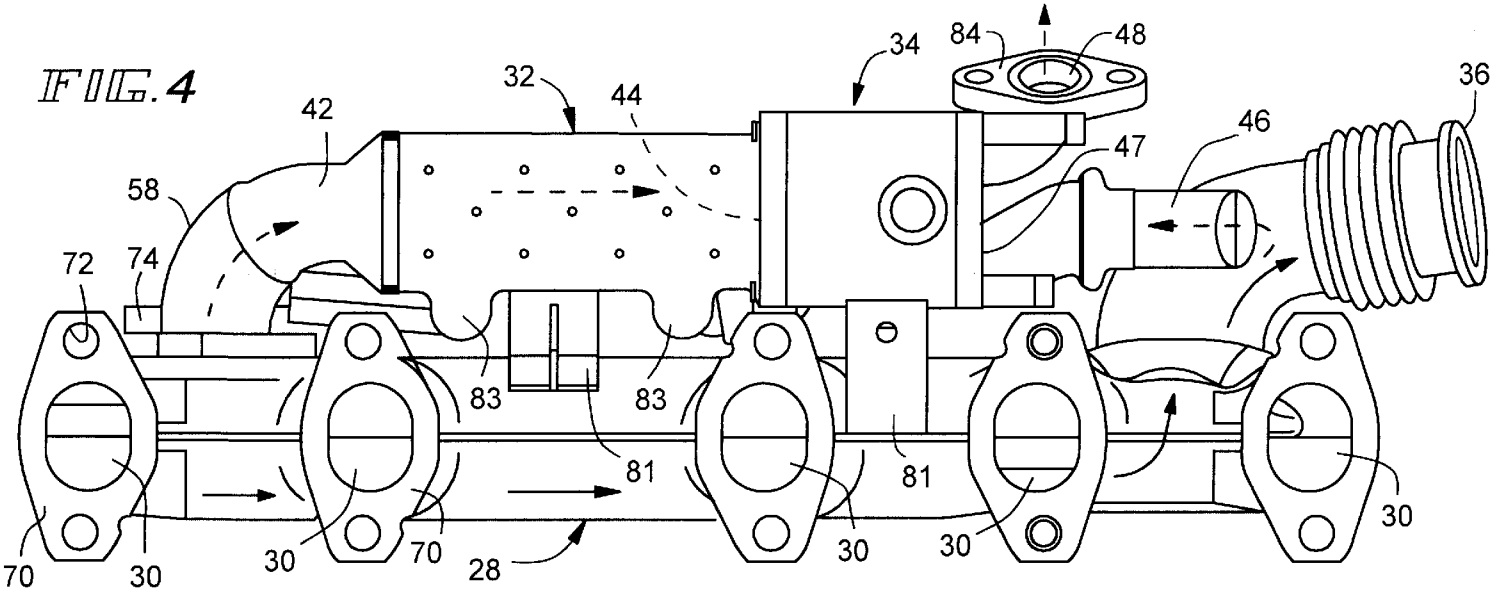
FIG. 4 is an elevation illustrating the components of an embodiment of the invention shown in FIG. 2.

Referring first to FIG. 1, an exemplary embodiment of an exhaust gas heat exchange system made according to the invention will be described generally. The description will involve the environment in which a typical diesel engine for a truck-like vehicle operates but it is to be understood that the invention is applicable to internal combustion engines other than diesel engines and may be employed with efficacy in stationary engine applications as well as in applications for engines other than trucks, as, for example, automobiles and construction, excavating, power generation, marine applications and others.

A six cylinder diesel engine is generally designated 10 and includes an intake manifold 12 having outlet connections 14 to each of the cylinders of the engine 10. The intake manifold 12 includes an inlet 16 for receiving recirculated exhaust gas from an exhaust gas recirculation line 18 as well as combustion air 20. While a single inlet is illustrated, two separate inlets could be employed. Combustion air on the line 20 is received from a charge air cooler 22 which in turn receives combustion air from the compressor side 24 of a turbocharger, generally designated 26.

Also included is an exhaust manifold, generally designated 28 which has a plurality of inlet connections 30, one to each of the cylinders of the diesel engine 10. An exhaust gas heat exchanger, generally designated 32, along with an exhaust valve, generally designated 34, are mounted on the heat exchanger 32, and specifically are together mounted on the manifold 28 in a manner to be seen.

Returning to the exhaust manifold 28, the same is elongated and at one end 36, includes a connection to the turbine side 38 of the turbocharger 26 to provide a driving force for the same whereby combustion air is compressed in the compressor side 24 and delivered to the charge air cooler 22 for ultimate delivery to the intake manifold 12. Near the opposite end 40 of the exhaust manifold 26 there is a connecting line 42 extending to the exhaust gas heat exchanger 32 and a first flow path (not shown in FIG. 1) thereof. The opposite end of the first flow path discharges at a first inlet 44 to the exhaust valve 34. At the same time, a connecting line 46 connects to a second inlet 47 to the exhaust valve 34. The exhaust valve 34 also includes an outlet 48 connected to the recirculation line 16. As will be seen, the exhaust valve 34 may be configured to direct cooled exhaust entering the exhaust gas heat exchanger 32 on the line 42 to the recirculation line 18 or to direct uncooled exhaust entering the inlet 47 to the recirculation line 18.

Turning now to FIG. 2, the valve 34 is illustrated in somewhat greater detail. As can be seen, the assembly of the heat exchanger 32 and the valve 34 results in an elongated assembly which is disposed approximately parallel to the exhaust manifold 28. The arrangement is such that the first inlet 44 to the valve 34 as well as the second inlet 47 are aligned on approximately the longitudinal axis of the assembly of the heat exchanger 32 and the valve 34. Also on the axis of elongation of that assembly is the inlet 50 to the first flow path within the exhaust gas heat exchanger 32. An outlet from that flow path, located in the vicinity of the first inlet 44 to the valve 34 and given the reference numeral 52 is also so aligned. The outlet 48 is at approximate right angles to the axis of elongation. Stated another way, the outlet 48 joins with the inlets 44 and 47 at a common point of intersection 54. At that point, a movable valve component in the form of a rotatable valve member 56 is located and is movable between the solid and dotted line positions illustrated in FIG. 2. When in the solid line position, recirculation flow back to the inlet manifold 12 (FIG. 1) will be through the exhaust gas heat exchanger 32 meaning that the recirculated exhaust will be cooled. On the other hand, when the valve member 56 is moved to the dotted line position, flow will be from the second inlet 47 to the outlet 48 and the exhaust gas heat exchanger 32 will be bypassed entirely. Thus, hot exhaust gas that has not been cooled will be directed back to the intake manifold 12.

Desirably, the connection 42 linking the exhaust manifold 26 to the heat exchanger 32 includes a bellows such as schematically illustrated at 58 to provide for thermal expansion and contraction. The bellows is connected to an outlet 60 from the exhaust manifold 28 near the end 40 while the connection 46 is connected to the exhaust manifold 28 at a point 62 adjacent the end 36.

The embodiment illustrated in FIG. 2 is preferred because the connection 62 is closely adjacent the end 36 whereat, by reason of its typical connection to a turbocharger 26 (FIG. 1), head pressure will be maximized. Thus pressure drop problems associated with ECR are minimized.

FIG. 3 shows an alternative embodiment wherein the locations of the heat exchanger 32 and the valve 34 are interchanged. That is to say, the inlet 50 to the first flow path is connected to the connection 46 whereas the connection 42 is connected to the second inlet 47. The outlet of the first flow path within the heat exchanger 32 is connected to the first inlet 44. The orientation of the inlets 44, 47 and outlet 48 is the same as in FIG. 2 except they have been reversed as illustrated. At the point of intersection 54 of the inlets and the outlet, the valve member 56 is provided as before. Again, it is movable between solid and dotted line positions. In the case of the embodiment shown in FIG. 3, when the valve member 56 is in the solid line position, uncooled exhaust gas will be directed to the recirculation line 18 whereas when the valve member 56 is in the dotted line position as shown in FIG. 3, cooled exhaust will be provided for recirculation.

In both the embodiments shown in FIGS. 2 and 3, it is desirable that the point of connection 62 of the connection 46 be reasonably adjacent to the end 36 of the manifold 28. As illustrated, the manifold 28 is elongated and the point 62 is at a distance of one-half the length of the manifold 28 or less from the end 36. Preferably, the spacing is one-third of the length of the manifold 28 or less. However, in some cases the point 62 may be located most anywhere along the length of the manifold 28.

Figure 5:
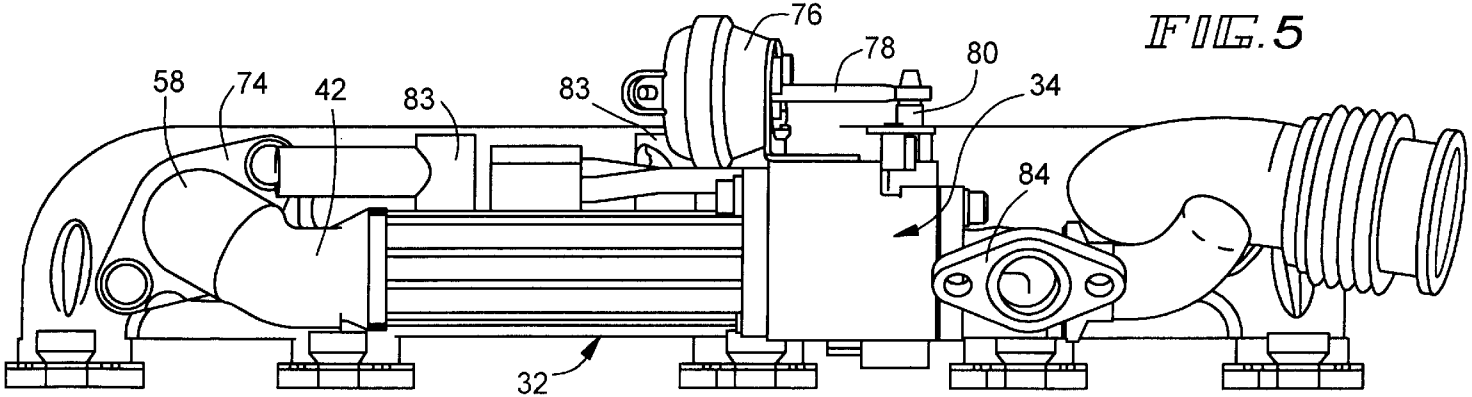
FIG. 5 is a plan view of the same components.

FIGS. 4 and 5 illustrate mechanical drawings of the assemblies shown in FIG. 2 (save for one less inlet connection 30) and it will be appreciated that the embodiment of FIG. 3 would be similarly configured except for the aforementioned reversing of the location of the heat exchanger 32 and the valve 34. It will be observed that flanges 70 are located about the inlets 30 to the manifold 28 and are provided with bolt holes 72 whereby the manifold may be bolted to an engine. Similarly, the bellows 58 may be provided with a flange 74 by which one end of the assembly of the heat exchanger 32 and 34 may be bolted to the manifold. An actuator, such as a conventional pneumatic actuator or a servo-motor 76 is connected via a link 78 to an eccentric 80 which in turn is connected to the valve member 56 for moving the valve member 56 between the aforementioned positions. Mounting brackets 81 connect the assembly of the heat exchanger 32 and exhaust valve 34 to the manifold 28. Coolant inlet and outlet ports 83 which typically receive engine coolant, are provided on the heat exchanger 32. A flange 84, similar to the flanges 70, is connected to the outlet port 48 and may be connected to the recirculation line 18 (FIG. 1) via the flange 84.

Figure 6:
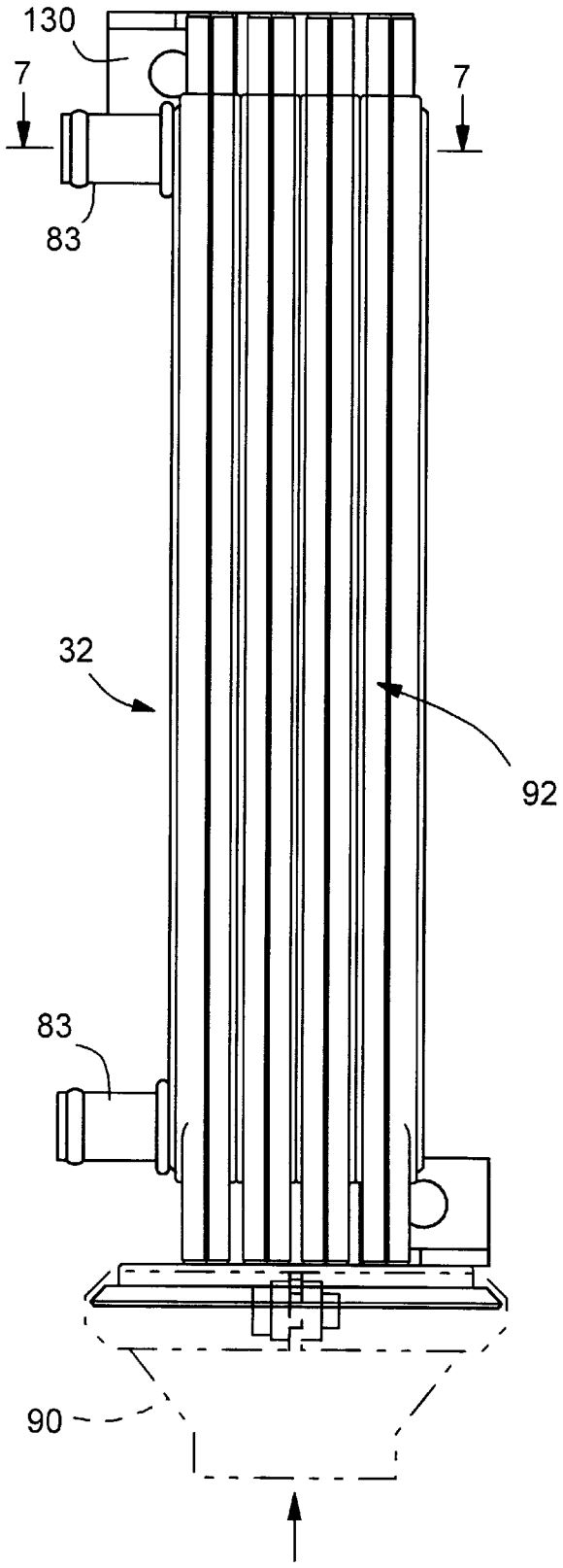
FIG. 6 is an enlarged elevation of an exhaust gas heat exchanger that may be employed in practicing the invention.
Figure 7:
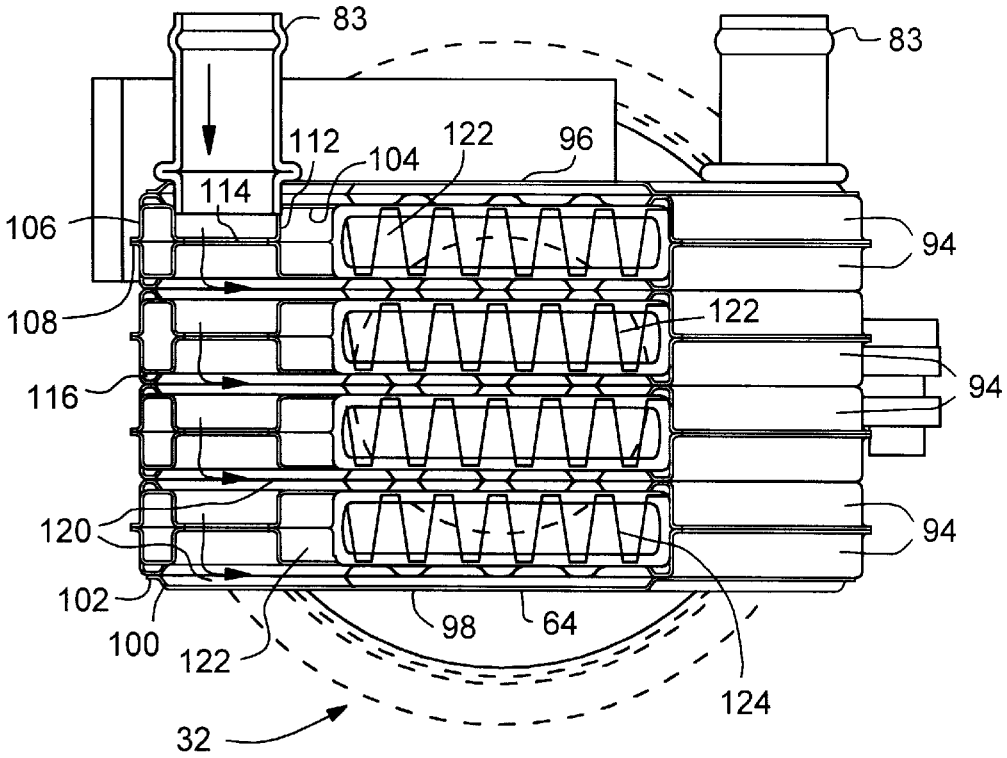
FIG. 7 is a sectional view of the exhaust gas heat exchanger taken approximately along the line 7—7 in FIG. 6.
Figure 8:
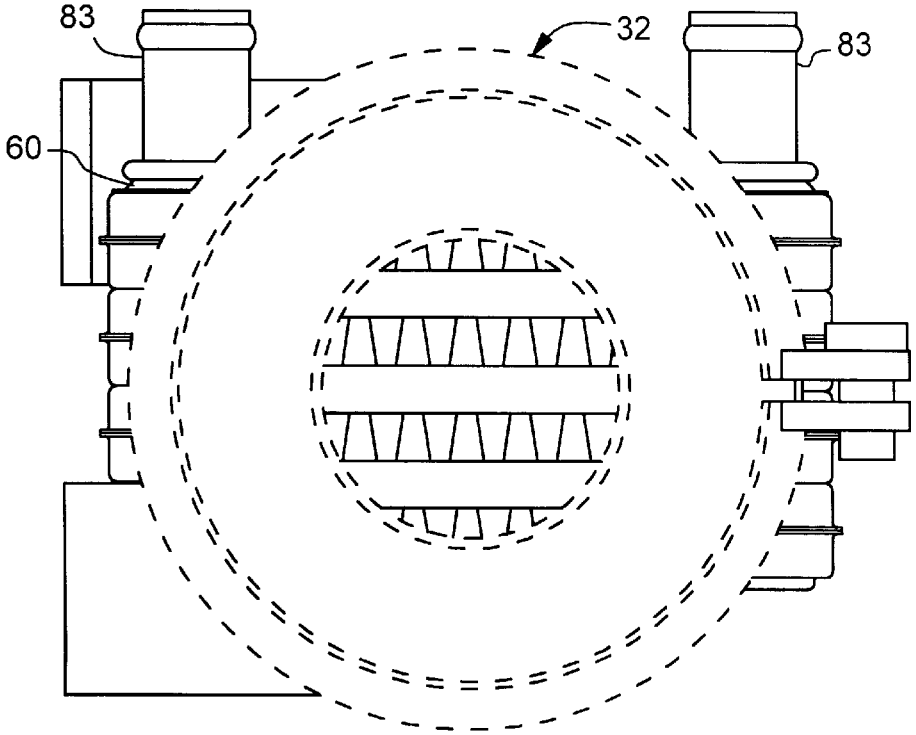
FIG. 8 is a side elevation of the exhaust gas heat exchanger taken from the bottom of FIG. 6.

While the exhaust gas heat exchanger 32 may take on many known forms known in the art, one preferred form is illustrated in FIGS. 6–8, inclusive. The inlet to the first flow path includes a frusto-conical port 90 connected to one end of a core, generally designated 92, made up of a series of stamped interior plates 94 flanked by end plates 96. As a result, a housingless configuration for the core 92 of the heat exchanger results. The end plates 96 include relatively shallow depressions 98 in their centers surrounded by upstanding peripheral walls 100 which terminate in outwardly directed flanges 102. Each interior plate 94 includes an enlarged, relatively deep interior depression 104 surrounded by an upstanding wall 106 which is peripheral and which terminates in outwardly directed flanges 108. At two locations in each of the plates 94 (only one of which is shown in FIG. 7), cylindrical bosses 112 are provided. The bosses 112 have central apertures 114. The interior plates 94 are stacked in alternating fashion as illustrated in FIG. 7 with the bosses 112 aligned. The inlet and outlet ports 83 extend through the uppermost one of the end plates 96 and into fluid communication with the bosses 112 so as to allow for the entry and exit of coolant into the core 92 of the heat exchanger.

Each of the interior plates 94 is also provided with a peripheral, exterior bead 116 at the base of the upstanding side walls 160. The interior plates 94 are assembled in alternating fashion as illustrated in FIG. 7 with the beads 116 at adjacent plates being abutted to one another. The assembly is brazed and as a consequence, sealed coolant flow paths 120 are provided between adjacent pairs of the plates. Between abutted pairs of the plates 94, exhaust gas passages 122 exist. Interior fins 124 are located in each of the exhaust gas flow paths 122 and preferably are quite smooth so as to avoid accumulation of particulate material that may be present in the exhaust stream. That is to say, the first flow paths referred to previously are defined by the flow paths 122 for the exhaust while a second flow path for the coolant is defined by the flow paths 120, A header 130 (FIG. 6) is located at the end of core 92 opposite the inlet 90 and is connected to each of the flow paths 122 to receive exhaust gas therefrom. The header 130 may have the valve 34 mounted directly thereto. From the foregoing, it will be appreciated that an exhaust gas heat exchange system made according to the invention is of compact construction and thus may be readily housed within, for example, the engine compartment of a vehicle. This compactness is significantly aided by the fact that the assembly of the heat exchanger 32 and the valve 34 is disposed parallel to the exhaust header 28. The same compactness of the assembly minimizes pressure drop and the advantageous location of the point 62 whereat the connector 46 connects from the manifold 28 assures that exhaust gas at its greatest head pressure will be available for recirculation. Appropriate sensors may be employed to control the actuator 76 and thus the position of the valve member 56 to selectively introduce the heat exchanger 32 into the flow system or remove it therefrom during warm-up, cold conditions, low and partial loads, etc. The arrangement of the two inlets and the outlet for the valve 34 provides an extremely simple valve construction and one that is not readily fouled by the exhaust gases flowing through it. The heat exchanger construction disclosed is essentially housingless and consequently, its cost and mass are both reduced from other sorts of heat exchangers conventionally employed in exhaust gas heat exchange systems.

We claim:

1. An exhaust gas heat exchange system for an internal combustion engine comprising:

an intake manifold included an inlet for recirculating exhaust gas;

an exhaust manifold having at least one inlet receiving exhaust gag from an engine and an outlet for discharging exhaust gas spaced from said inlet(s);

an exhaust gas heat exchanger including a first flow path having an inlet connected to said exhaust manifold to receive exhaust gas therefrom, an outlet for discharging cooled exhaust gas and a second flow path in heat exchange relation with said first flow path for receipt of a coolant whereby exhaust gas flowing in said first flow path may be cooled;

an exhaust valve having a first inlet connected to said first flow path outlet, a second inlet connected to said exhaust manifold, an outlet connected to said intake manifold inlet, and a valve mechanism having at least one movable component, said movable component(s) being movable between positions connecting a) said exhaust valve first inlet to said exhaust valve outlet and b) said exhaust valve second inlet to said exhaust valve outlet; and an actuator connected to said valve mechanism for moving said valve mechanism component(s) between said positions.

2. The exhaust gas heat exchange system of claim 1 wherein said exhaust valve second inlet is connected to said exhaust manifold at a location downstream of said exhaust manifold inlet(s) and upstream of said exhaust manifold outlet.

3. The exhaust gas heat exchange system of claim 2 wherein said exhaust valve second inlet is connected to said exhaust manifold closely adjacent said exhaust manifold outlet.

4. The exhaust gas heat exchange system of claim 1 wherein said first flow path inlet, and said exhaust valve first and second inlets are approximately aligned.

5. The exhaust gas heat exchange system of claim 1 wherein said exhaust gas heat exchanger and said exhaust valve are mounted on said exhaust manifold.

6. The exhaust gas heat exchange system of claim 1 wherein said exhaust manifold is elongated and said second inlet is connected to said exhaust manifold at a location that is spaced from said exhaust manifold outlet a distance equal to one-half or less of the length of said exhaust manifold.

7. The exhaust gas heat exchange system of claim 6 wherein said distance is equal to one-third or less of the length of said exhaust manifold.

8. The exhaust gas heat exchange system of claim 1 wherein said exhaust manifold is elongated and said exhaust manifold outlet is adjacent one end thereof, said exhaust gas heat exchanger first flow path inlet having a connection to said exhaust manifold at a location intermediate the ends thereof.

9. The exhaust gas heat exchange system of claim 8 wherein said connection is closely adjacent an end of said exhaust manifold opposite said one end.

10. The exhaust gas heat exchange system of claim 1 wherein said exhaust gas heat exchanger and said exhaust manifold are elongated and said exhaust valve is mounted on one end of said exhaust gas heat exchanger to form an elongated assembly, said assembly being disposed generally parallel to said exhaust manifold.

11. The exhaust gas heat exchange system of claim 1 wherein said exhaust valve first inlet, second inlet and outlet intersect at a common location and said valve component(s) includes a valve member located at said common location.

12. The exhaust gas heat exchange system of claim 11 wherein said exhaust gas heat exchanger is elongated and has an axis of elongation, and said exhaust valve first and second inlets are approximately aligned on said axis of elongation, said exhaust valve outlet being disposed approximately transverse to said axis of elongation.

* * * * *